United States Patent [19]

Spisiak et al.

[11] 4,020,877

[45] May 3, 1977

[54] WEFT INJECTION SEQUENCE CONTROLLER FOR A FLUID-JET LOOM

[75] Inventors: Juraj Spisiak; Milos Jansa, both of Brno; Miloslav Bezdek, Charvatska Nova Ves; Stanislav Ferdus, Brno, all of Czechoslovakia

[73] Assignee: Vyzkumny a vyvojovy ustav Zavodu vseobecneho strojirenstvi, Brno, Czechoslovakia

[22] Filed: June 9, 1976

[21] Appl. No.: 694,236

[30] Foreign Application Priority Data

June 10, 1975 Czechoslovakia ..... 4033/75

[52] U.S. Cl. ..... 139/435

[51] Int. Cl.[2] ..... D03D 47/30

[58] Field of Search ..... 139/435; 226/95, 97

[56] References Cited

UNITED STATES PATENTS

| | | | |
|---|---|---|---|
| 3,705,608 | 12/1972 | Vermeulen | 139/435 |
| 3,821,972 | 7/1974 | Svaty et al. | 139/435 |

*Primary Examiner*—Henry S. Jaudon

[57] ABSTRACT

An electronic sequencer for successively introducing a weft propelling fluid, such as air, into the successive nozzles of a fluid-jet loom is described. A plurality of separate control paths, individual to the succession of nozzles, each includes a triggerable pulse generator and an associated actuator connected in series with an electromagnetic valve that couples the propelling fluid to the successive nozzles. The pulse generator associated with the first nozzle in the sequence is triggered by a detector that is actuated once during each cycle of the loom. The remaining pulse generators are coupled to the output of an associated one of a plurality of delay circuits. The delay circuit associated with the second nozzle in the succession is triggered by the output of the detector, while the input of each remaining delay circuit is coupled to the output of the next-preceeding delay circuit. With such arrangement, the generation of an initiating pulse by the detector automatically cycles fluid to the successive nozzles with a duty cycle which is rapidly and easily adjustable by changing the pulse width and/or the retardation time of the pulse generators and the delay circuits, respectively.

4 Claims, 2 Drawing Figures

WEFT INJECTION SEQUENCE CONTROLLER FOR A FLUID-JET LOOM

BACKGROUND OF THE INVENTION

The invention relates to multi-nozzle fluid jet looms, and more particularly for facilities in such looms for cyclically routing a propelling fluid to successive ones of the nozzles for conveying a weft thread along an operating path to be inserted into a shed of the loom.

Conventionally, fluid cycling systems of this type have employed cam-controlled slide valves which, being purely mechanical, have several disadvantages. Among such disadvantages is the fact that the rate of switching of the fluid among the successive nozzles can be adjusted, if at all, only by initially stopping the machine, so that adjustments of the weft insertion operation is extremely slow. Moreover, such mechanical types of fluid distributors are clumsy to mount, and have been found to be grossly inefficient, with leakage and hydraulic losses frequently amounting to 50–70% of the pressure gradient.

In an attempt to alleviate the disadvantages of such all-mechanical fluid distributor designs, a cycling system has been devised wherein a plurality of electromagnetically operated, normally closed valves are individually associated with the successive nozzles. In such system, the valves are operated in sequence at a preselected time for a suitable interval normally chosen to permit the weft to be propelled from one nozzle to the succeeding nozzle. In order to operate the respective valves, a plurality of sensors have been individually disposed at successive points along the operating path of the weft, each sensor being arranged to initiate an operating pulse for the associated valve when the weft has been propelled for a suitable interval along such path.

The last-mentioned system, in which each of such sensors are individually associated with a separate one of the valves, has proved to be quite complicated and expensive, particularly where such sensors have been assigned the task of not only initiating the operation of the associated valve, but also of terminating the operation of such valve.

SUMMARY OF THE INVENTION

Such disadvantages are overcome with the fluid-cycling facilities of the invention for operating a sequence of normally closed, electromagnetically operated valves of the above type for propelling a weft thread through the succession of nozzles in the fluid-jet loom.

In an illustrative embodiment, a single detector is coupled to the jet loom drive for initiating a triggering pulse during each cycle of operation of the loom. The output of the detector is coupled to the input of a variable-duration pulse generator, which is coupled to the valve associated with the first nozzle in the loom sequence through a suitable actuator. Upon triggering by the detector, the pulse generator causes the valve to be operated for the pulse duration, which may be electronically adjustable at will.

A plurality of additional, identical pulse generators are individually coupled to the valves that are connected to the remaining nozzles in the sequence through appropriate actuators. Unlike the first pulse generator, however, the input of such remaining pulse generators are triggered on by a pulse transition occurring at the output of an appropriate one of a succession of delay circuits, whose retardation time, relative to a pulse applied to the input thereof, may be adjustable to a second interval representing the time necessary for the weft thread to be propelled from one nozzle to the next.

The input of the delay circuit associated with the second nozzle in the sequence is coupled to the output of the single detector to be operated thereby. The input of each remaining delay circuit is coupled to the output of the next-preceeding delay circuit. With this arrangement, once a pulse is produced at the output of the detector during each operating cycle of the loom, the successive valves, and thereby the successive nozzles, are successively supplied with fluid without the necessity of associating separate detectors at different points of the weft advance path, as in the prior art.

A conventional weft length monitor may be coupled to the advancing weft exiting from the last nozzle in the sequence, which last nozzle may in turn be embodied as a weft ejector and tensioner. The monitoring apparatus is preferably of the type which is operated over the duration of a pulse applied to its input; in such case, the input of the monitoring means may be coupled to an auxiliary pulse generator identical to the abovementioned pulse generators. In addition, the input of such auxiliary pulse generator is coupled to the output of the delay circuit associated with the ejection and tensioning nozzle.

Preferably, both the retardation time of the delay circuits and the pulse duration interval of the several pulse generators are independently adjustable, whereby wide-range flexibility of adjustment of the various parameters of the weft insertion system may be accomplished while the fluid-jet loom remains in full operation.

BRIEF DESCRIPTION OF THE DRAWING

The invention is further set forth in the following detailed description taken in conjunction with the appended drawing, in which.

DETAILED DESCRIPTION

Figure 1:
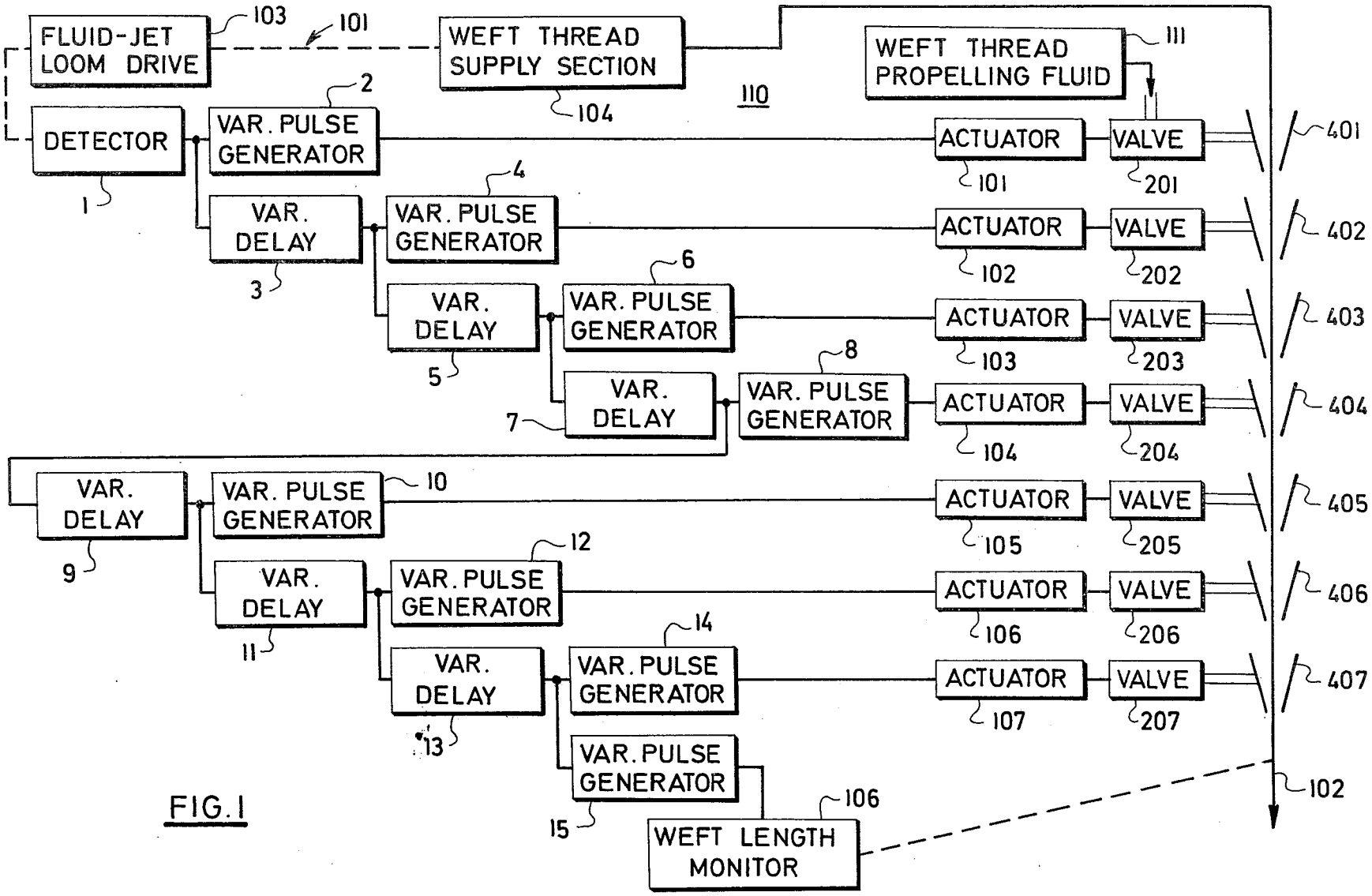
FIG. 1 is a block diagram of an arrangement constructed in accordance with the invention for cyclically and sequentially applying a weft-propelling fluid to a succession of weft insertion nozzles of a fluid-jet loom.

Referring now to the drawing, an illustrated portion 101 of a fluid-jet loom is depicted for propelling a weft thread 102 through a succession of aligned nozzles 401–407 at intervals defined by a first rate of operation of a loom drive 103. The weft 102, which may be obtained from a conventional weft supply source 104, exits from the last nozzle 407 in the succession to be inserted in the loom shed (not shown), and for this purpose such last nozzle may function as an ejector and tensioner for the weft thread.

A conventional weft thread monitor 408 may be associated with the moving weft 102 at the outlet of the ejector nozzle 407 for sensing the length of the weft over an operative interval established by a pulse of corresponding duration applied to an input 106 of the monitor 408, in the manner described below.

Each of the successive nozzles 401–407 is supplied with a weft propelling fluid, such as air, over the period of operation of an associated normally closed, electromagnetically operated one of a corresponding plurality of valves 201–207. (It will be understood that any integral number N of paths including a valve and a nozzle may be provided, depending on the application of the loom; illustratively, N = 7 in the illustrated embodiment).

In order to initiate operation of the successive valves 201–207 and thereby to successively urge the weft through the output orifices of the successive nozzles 401–407, there is provided a sequence controller 110 which is operated at the rate of the loom drive 103 and which is triggered into operation once during each loom cycle by means of an output trigger 501 (FIG. 2) emitted from a suitable detecting element 1 (FIG. 1), which is coupled to a suitable portion of the drive 103.

In accordance with the invention, the sequencer 110 is formed from a plurality of interconnected electronic elements which cooperate in such a way that only a single one of the detecting elements 1 is necessary for controlling the flow of weft propelling fluid from a suitable source 111 to the successive nozzles 401–407 via the valves 201–207.

In particular, the output of the detecting element 1 is coupled to the input of a variable-duration pulse generator 2, which responds to the initiation of the trigger pulse at the output of the detecting element 1 to yield a succession of pulses 502 at the rate of operation of the loom drive 103, each of the pulses 502 being applied to the input of a conventional valve actuator 101 which opens the associated valve 201 during the time that each pulse 502 is applied to the actuator 101. Such interval, represented at $T_2$ in FIG. 2, accordingly determines the interval that the first nozzle 401 is effective to propel the associated portion of the weft thread 102 therethrough toward the inlet of the next-succeeding nozzle 402. A plurality of additional variable-duration pulse generators 4, 6, 8, 10, 12 and 14, each identical to the generator 2, are similarly coupled to the inputs of the remaining valve actuators 102–107 for opening the corresponding valves 202–207 for an adjustable interval corresponding to the individually determinable pulse duration of such pulse generators.

Figure 2:
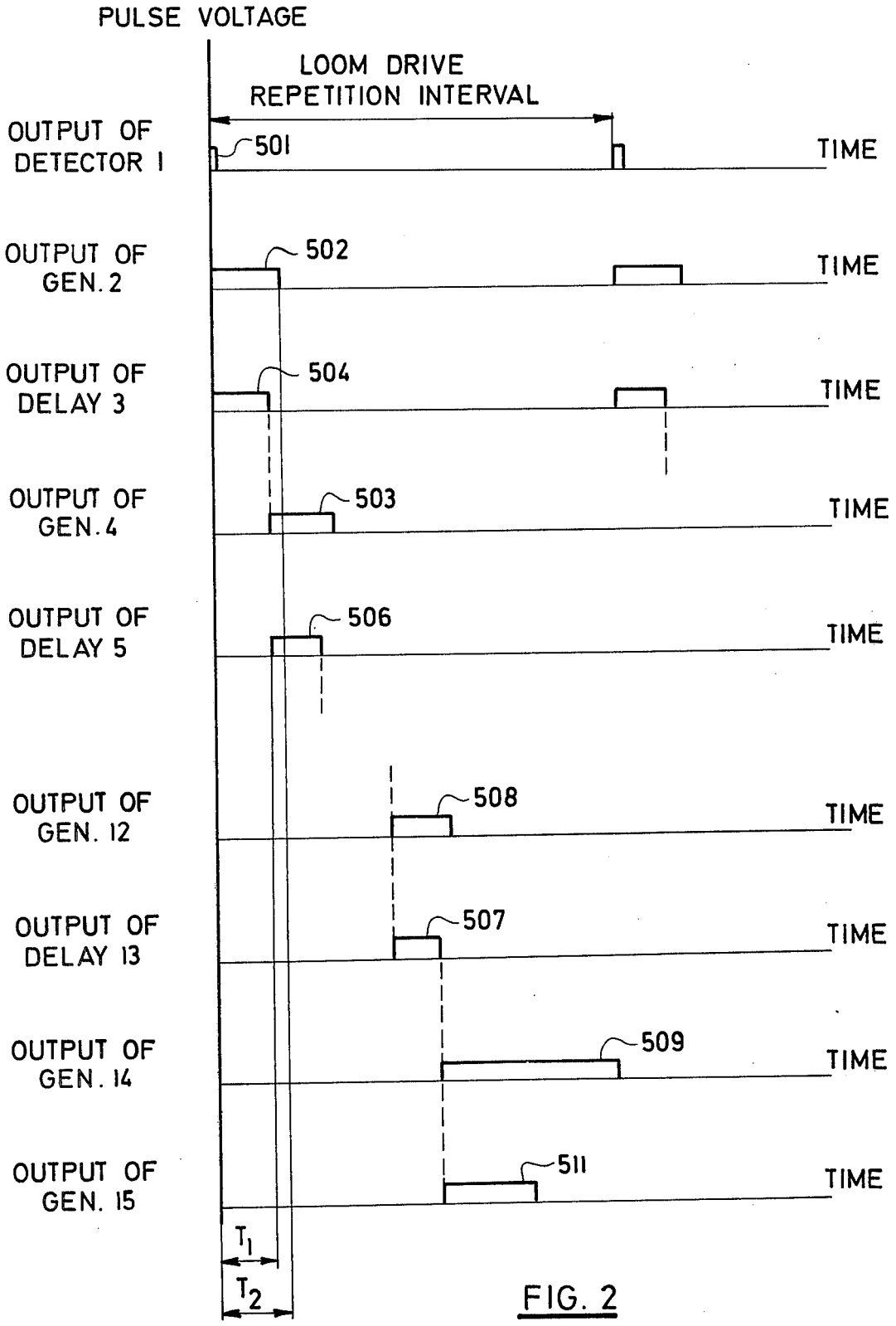
FIG. 2 is a set of curves illustrating the pulse outputs at various portions of the arrangement of FIG. 1.

The pulse sequence from the generator 4 associated with the second nozzle 402 in the sequence is designated at 503 and is triggered upon the occurrence of an output pulse transition from an associated delay circuit 3. The delay circuit 3, which may have a variable retardation time denoted at $T_1$ in FIG. 2, is in turn excited at its input by the trigger pulse from the detecting element 1; the retardation interval of the delay circuit 3 is indicated at 504 in FIG. 2.

A plurality of additional delay circuits 5, 7, 9, 11 and 13, each of which may be identical with the variable-retardation delay circuit 3, have their outputs coupled to the inputs of the respective pulse generators 6, 8, 10, 12 and 14 associated with the remaining nozzles 403–407 in the sequence.

In addition, the output of the first delay circuit 3 is coupled to the input of the delay circuit 5 to initiate the retardation interval of the latter, indicated at 506 in the drawing. In like manner, the output of the delay circuit 5 is coupled to the input of the next-succeeding delay circuit 7, and so on. For simplicity of presentation, only the retardation interval (designated 507) of the last delay circuit 13 is depicted in the drawing.

The trailing edge, or outlet pulse transition, of the delay circuit 3 is effective to trigger the valve-actuating pulse 503 of the pulse generator 4 in the manner described above. At the same instant, such outlet pulse transition is effective to start the retardation interval 506 of the next-succeeding delay circuit 5; and so on. Each of the retardation intervals, which are individually adjustable, may be quickly and easily varied in accordance with the nozzle-to-nozzle distance and weft velocity of the loom, whereby in any particular case each pulse generator is inhibited from operating by the delay circuit on its input until the weft thread exiting from the next-preceeding nozzle has reached the output orifice of its own nozzle to be propelled further, thereby to be further urged along the operating path of the loom.

For further ease of presentation, the output pulses of the intermediate pulse generators 6, 8 and 10 have not been specifically illustrated; however, the output pulse of the generator 12 is indicated at 508, while the output pulse of the generator 14 is indicated at 509. The obvious differences in pulse duration between the latter two pulses is depicted merely to indicate the individual adjustability of the pulse duration, with the ejector nozzle 407 being supplied with fluid for a longer interval in order to efficiently effect its ejection and tensioning function.

In order to operate the weft thread length monitor 408, the input 106 thereof is coupled to the output of an auxiliary, variable-duration pulse generator 15, which may be identical in construction to the generators 2, 4, 6, 8, 10, 12 and 14, and which operates at the repetition interval of the loom drive 103. Each output pulse from the generator 15, depicted at 511 in FIG. 2, is triggered on by the output pulse transition of the delay circuit 13, whereby the monitor 408 may be operated for a prescribed interval starting with the instant that the weft 102 starts to emerge from the exit orifice of the ejector nozzle 407. Alternatively, if desired, a delay circuit similar to the circuit 3, 5, 7, 9, and 13 may be interposed between the output of the delay circuit 13 and the input of the pulse generator 15 for retarding the instant of commencement of the pulse length monitoring operation.

In the foregoing, an illustrative arrangement of the invention has been described. Many variations and modifications will now occur to those skilled in the art. It is accordingly desired that the scope of the appended claims not be limited to the specific disclosure herein contained

What is claimed is:

1. In a fluid jet loom operable at a first rate and having N successive nozzles adapted to receive a propelling fluid from a fluid source for successively conveying a weft thread along a prescribed operating path, the loom having N normally closed, electromagnetically actuable valves individually coupling the fluid source to the N successive nozzles, each valve being operable for conveying fluid to the associated nozzle while the valve is operated, and means for cyclically operating the successive nozzles, the improvement wherein the cyclic operating means comprises, in combination, detecting means operable at the first rate for producing an initiating impulse at a specified instant during each cycle of operation of the loom, N first means for generating, at the first rate, an individual succession of pulses having a duration equal to a first interval, N actuator means coupled between the outputs of the respective first pulse generating means and individual ones of the valves for operating the valves over the duration of the pulse emitted from the associated first pulse generating means at the first rate, N−1 delay means each adapted to provide a pulse transition at its output at the conclusion of a second interval following the application of a pulse transition to its input, first means for coupling the output of the detecting means to the input of the first pulse generating means associated with the first nozzle in the succession to initiate a pulse from said first pulse generating means when the initiating impulse is emitted from the detecting means, means for individually coupling the outputs of the respective delay means to the inputs of the remaining N−1 first pulse generating means to initiate a pulse from each first pulse generating means in response to a pulse transition at the output of the associated delay means, means for coupling the output of the detecting means to the input of the delay means associated with the second nozzle in the succession, and means for individually coupling the outputs of each delay means to the input of the next succeeding one of the delay means.

2. The improvement as defined in claim 1, in which the first interval is adjustable in length.

3. The improvement as defined in claim 1, in which the second interval is adjustable in length.

4. The improvement as defined in claim 1, further comprising means coupled to the weft thread and operable over the duration of a pulse applied thereto for monitoring the length of the weft thread, second pulse generating means identical to each of the first pulse generating means, means for coupling the output of the second pulse generating means to the input of the monitoring means, and means for applying the output of the delay means associated with the last nozzle in the succession to the input of the second pulse generating means.

* * * * *